United States Patent [19]

Hwang

[11] Patent Number: 4,736,982

[45] Date of Patent: Apr. 12, 1988

[54] CONVERTIBLE CHAIR

[76] Inventor: Sunny S. Hwang, 24948 Calaroga Ave., Hayward, Calif. 94545

[21] Appl. No.: 796,181

[22] Filed: Nov. 7, 1985

[51] Int. Cl.[4] ..... A47C 13/00

[52] U.S. Cl. ..... 297/118; 297/316; 297/423; 297/429

[58] Field of Search ..... 297/429, 423, 433, 195, 297/118, 313, 316, 319, 19; 182/33, 35

[56] References Cited

U.S. PATENT DOCUMENTS

| | | | |
|---|---|---|---|
| D. 265,612 | 8/1982 | Gusrud | D6/38 |
| 847,880 | 3/1907 | Barker et al. | 297/319 |
| 2,666,210 | 1/1954 | Wiley | 297/118 X |
| 3,005,660 | 10/1961 | Winick | 297/319 X |
| 3,530,954 | 9/1970 | Schmidt | 297/118 X |
| 3,669,493 | 6/1972 | Vowles | 297/429 |
| 3,712,666 | 1/1973 | Stoll | 297/313 X |
| 4,216,994 | 8/1980 | Benoit | 297/417 X |
| 4,328,991 | 5/1982 | Mengshoel | 297/271 |
| 4,369,997 | 1/1983 | Desanta | 297/319 X |
| 4,377,309 | 3/1983 | Mengshoel | 297/423 |
| 4,614,378 | 9/1986 | Picou | 297/92 |

FOREIGN PATENT DOCUMENTS

| | | | |
|---|---|---|---|
| 2026929 | 12/1970 | Fed. Rep. of Germany | 297/319 |
| 2310729 | 12/1976 | France | 297/118 |
| 72715 | 3/1916 | Switzerland | 297/118 |
| 15208 | of 1885 | United Kingdom | 297/118 |

*Primary Examiner*—Kenneth J. Dorner
*Assistant Examiner*—Mark W. Binder
*Attorney, Agent, or Firm*—Robert R. Tipton

[57] ABSTRACT

A chair that converts from a conventional seat and back rest type of chair to a seat and knee rest type of chair utilizes a seat that is pivotally connected to a base support that, when pivoted, is rotated from a generally horizontal plane when used as a conventional chair, to a predetermined angle of tilt. The back rest is also pivotally connected to the base support by a bracket arm that permits the back-knee rest to be moved from a position above the plane of the seat, to support the back of a person sitting on the horizontally positioned seat, to a position below the plane of the seat and at a predetermined angle of tilt to support the knees of a person sitting on the tilted seat.

4 Claims, 5 Drawing Sheets

FIG. 9
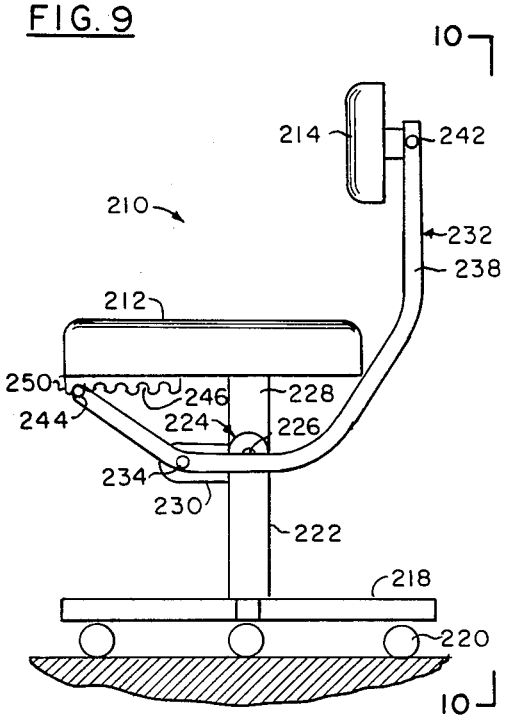
FIG. 10
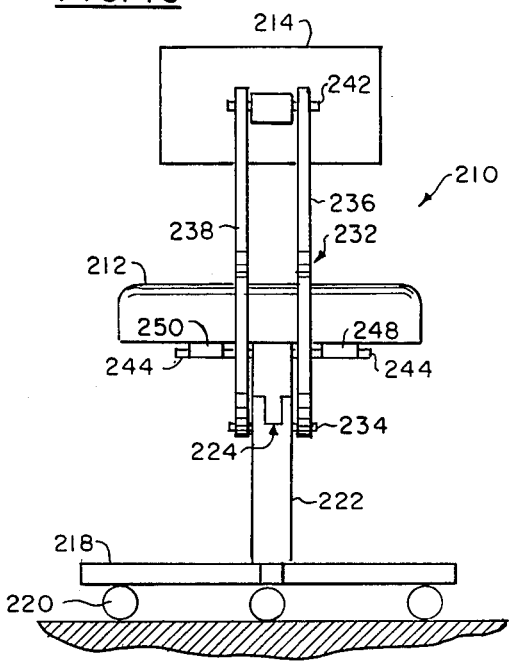
FIG. 11
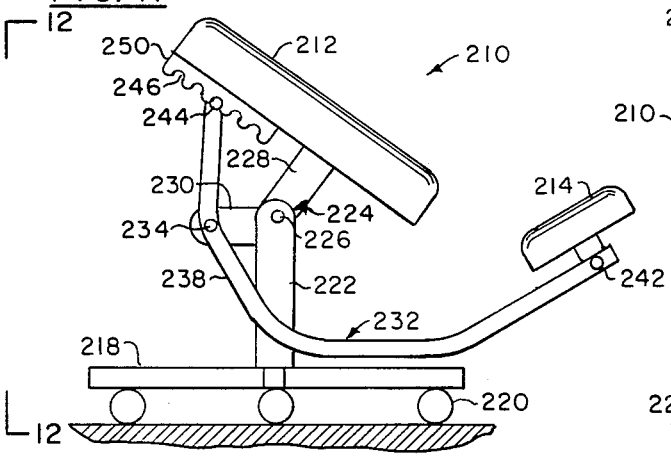
FIG. 12
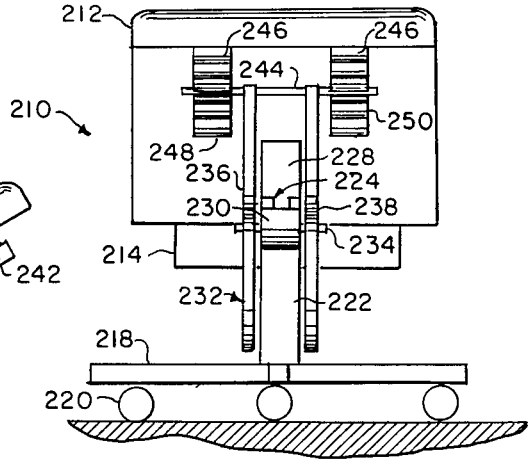
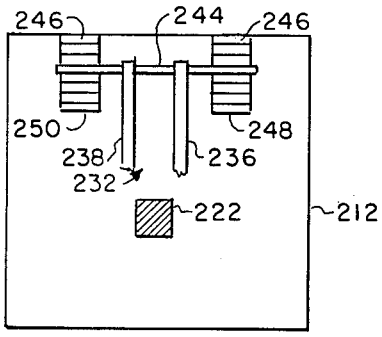
FIG. 13

CONVERTIBLE CHAIR

BACKGROUND OF THE PRIOR ART

This invention relates generally to chairs and in particular to chairs that convert from a chair comprising a seat and back rest to a chair comprising a seat and knee rest and back again.

Conventional chairs utilizing a seat and back rest are well known as are conventional chairs in which the tilt of the seat and the tilt of the back rest can be adjusted by various means and mechanisms.

In these chairs, the adjustments are primarily for the purpose of increasing the comfort of the person sitting in the chair or adjusting the tilt of the seat and back rest to accommodate persons of different sizes.

Similarly, backless chairs utilizing a forward tilted seat and a knee rest are also well known.

However, chairs that convert from the conventional form of a seat, in which the back rest is located above the level of the seat, into a backless chair utilizing a tilted forward seat and knee rest located below the level of the seat are not well known and represents an improvement over both types of chair.

SUMMARY OF THE INVENTION

Applicant's improvement is a convertible chair comprising a base support in which the seat is pivotally connected to the base support and a back-knee rest that is also pivotally connected to the base support.

In the first position, the seat is positioned in a generally horizontal plane to support the thighs and buttocks of a user of the chair and the back-knee rest is positioned above the level of the seat to support the back of the user of the chair.

By rotating or pivoting the seat about its pivot point either along a vertical plane or along a tilted plane, the seat is caused to tilt from a first position as a conventional chair in which the seat is adapted to support the buttocks and thighs of a user of the chair and the back-knee rest is adapted to support the back of a user of the chair, to a backless chair with the seat tilted at a predetermine angle.

By rotating or pivoting the back-knee rest about its pivot point either along a vertical plane or along a tilted plane, the back-knee rest is caused to move from a first position located above the level of the seat to a second position below the level of the seat and at a predetermine angle of tilt, at which position the seat is adapted to support the thighs and buttocks of the user of the chair and the back-knee rest is adapted to support the knees of the user of the chair.

It is, therefore, an object of the present invention to provide a chair that is convertible from a conventional chair to a backless knee rest chair or from a backless knee rest chair to a conventional chair.

It is a further object of the present invention to provide a chair in which the seat and back-knee rest are pivotally connected to the common base support and, when pivoted about their respective pivot points, convert the chair from a conventional chair to a backless knee rest type chair or from a backless knee rest chair to a conventional chair.

It is yet another object of the present invention to provide a chair in which the seat and back-knee rest are convertible from a conventional chair to a back-knee rest chair in which the back-knee rest is adjustable relative to the seat.

It is a further object of the present invention to provide a chair that can be converted from a conventional chair to a backless knee rest chair or a backless knee rest chair to a conventional chair with the simultaneous pivoting of the seat and back-knee rest about their respective pivot points through the pivoting of the back-knee rest about its pivot point.

These and other objects of the present invention will become manifest upon study of the following description when taken together with the drawings.

BRIEF DESCRIPTION OF THE DRAWINGS

FIG. 9 is a side elevational view of a third embodiment of the convertible chair of the present invention showing the chair with the seat and back-knee rest in their conventional relationship.

FIG. 10 is a back elevational view of the chair of FIG. 9 taken at line 10—10.

FIG. 11 is a side elevational view of the chair of FIG. 9 in its converted configuration with the seat tilted at an angle and the back-knee rest disposed below the level of the seat at a predetermined angle to the horizontal.

FIG. 12 is a back elevational view of the converted chair of FIG. 11 taken at line 12—12.

FIG. 13 is a bottom view of the underside of the seat of FIG. 11 taken at lines 13—13 showing the method of holding tilt of the seat in position.

DESCRIPTION OF THE PREFERRED EMBODIMENTS

Figure 1:
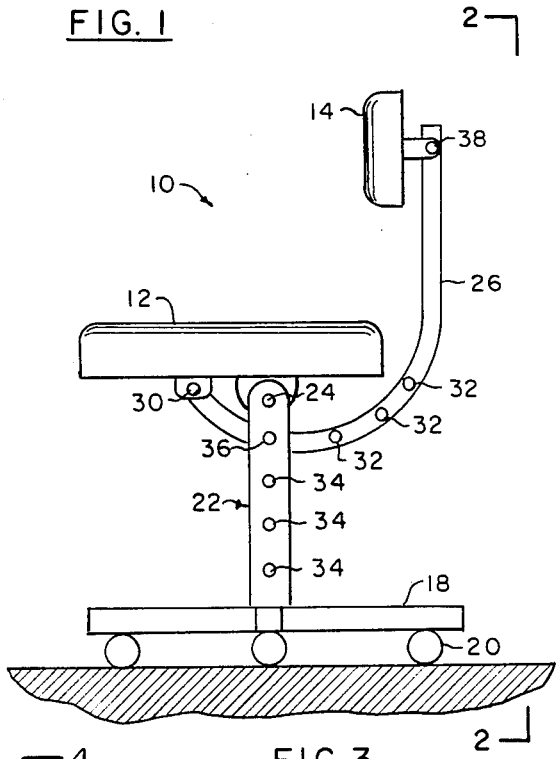
FIG. 1 is a side elevational view of the convertible chair of the present invention showing the chair with the seat and back-knee rest in their conventional relationship.
Figure 2:
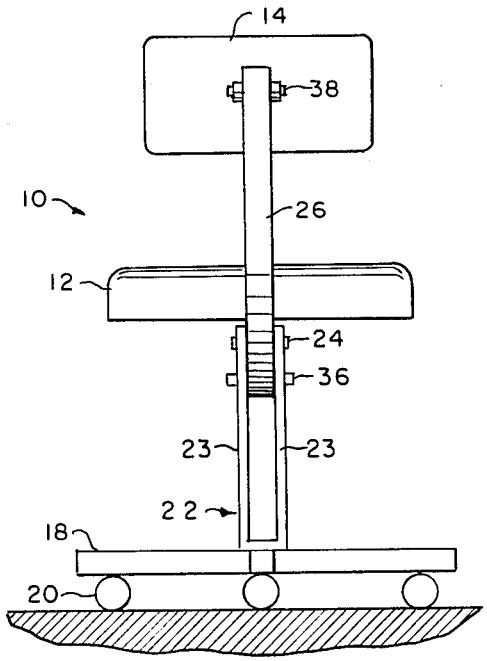
FIG. 2 a back elevational view of the chair of FIG. 1 taken at line 2—2.
Figure 3:
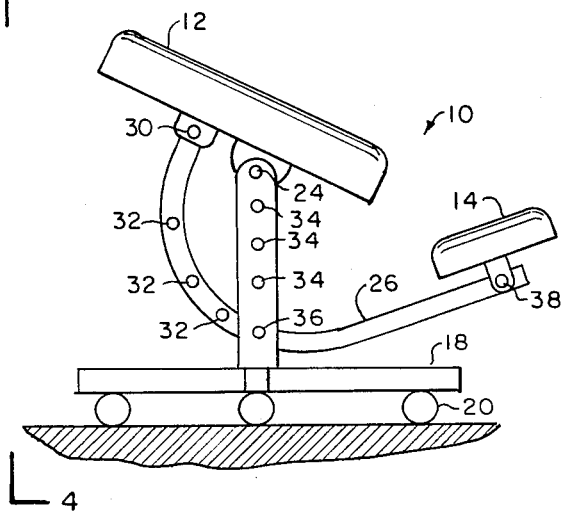
FIG. 3 is a side elevational view of the chair of FIG. 1 in its converted configuration with the seat tilted at an angle and the back-knee rest disposed below the level of the seat at a predetermined angle to the horizontal.
Figure 4:
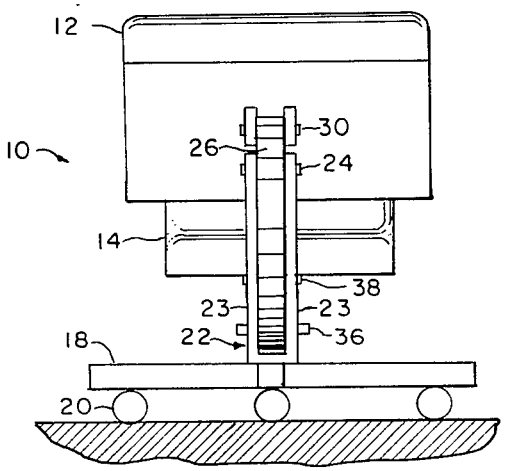
FIG. 4 is a back elevational view of the converted chair of FIG. 3 taken at line 4—4.

With reference to FIGS. 1 through 4, there is illustrated a first embodiment of the convertible chair 10 of the present invention showing it configured as a conventional chair in FIGS. 1 and 2 and configured as a backless knee rest chair in FIGS. 3 and 4.

FIG. 1 is a side elevational view of the convertible chair 10 of the present invention in which seat 12 is disposed in a generally horizontal position with back-knee rest 14 disposed in a generally vertical position and located above the level of seat 12.

In this position seat 12 is adapted to support the buttocks and thighs of the user while back-knee rest 14 is adapted to support the back of the user.

FIG. 2 is a back elevational view of convertible chair 10 illustrated in FIG. 1 taken at line 2—2.

FIG. 3 is a side elevational view of convertible chair 10 in its converted position in which, what was the front of horizontally disposed seat 12 has been rotated and is now tilted upwardly from the horizontal while back-knee rest 14 has been rotated downwardly such that the top of vertically disposed back-knee rest 14 in FIG. 1, is now tilted from the vertical and back-knee rest 14 is positioned below the level of seat 12.

In this position seat 12 is adapted to support the buttocks and thighs of the user while back-knee rest 14 is adapted to support the knees of the user of the chair.

FIG. 4 is a back elevational view of convertible chair 10 shown in FIG. 3 taken at line 4—4.

Convertible chair 10 comprises, basically, a base support 18, mounted on a set of casters or wheel members 20.

Attached to base support 20 and projecting upwardly therefrom is support pedestal 22 comprising a pair of parallel disposed support legs 23 shown in FIGS. 2 and 4.

Pivotally mounted proximate the top of pedestal 22, using hinge or pivot pin 24, is seat 12.

Back-knee rest arcuate bracket arm 26 is used to connect back-knee rest 14 to base support pedestal 22 and seat 12.

In particular, the lower end of back-knee rest bracket arm 26 is pivotally connected to the underside of seat 12 using pivot pin 30. Back-knee rest arcuate bracket arm 26 is also provided with a plurality of spaced apart holes 32 along the arcuate portion of its length which are coordinated with spaced apart holes 34 in pedestal 22 to receive locking pin 36. Locking pin 36 is adapted to simultaneously engage a hole 32 in back-knee rest bracket arm 26 and a hole 34 in support pedestal 22 to rigidly connect back-knee rest arcuate bracket arm 26 to pedestal 22.

Back-knee rest 14 is also pivotally connected, using pivot pin 38, to the end of back-knee rest bracket arm 26 distal seat 12.

In FIG. 1, it can be seen that the fixed position of seat 12 relative to back-knee rest 14 is maintained by the use of pins 24, 30 and 36 which define the points of a structural triangle.

To convert chair 10 from a conventional chair, as illustrated in FIGS. 1 and 2, to a knee rest chair, illustrated in FIGS. 3 and 4, pin 36 is removed from holes 32 and 34 thus leaving back-knee rest arcuate bracket arm 26 free to rotate about pivot pin 30. Concurrently, seat 12 is now allowed to rotate freely about pivot pin 24.

Back-knee rest bracket arm 26 is then rotated downwardly to the position shown in FIG. 3 in which back-knee rest 14 is positioned below the level of seat 12.

After the tilt of seat 12 and the location of back-knee rest 14 have been adjusted for maximum comfort, pin 36 is then inserted through the hole 32 in back-knee rest bracket arm 26 and the hole 34 in pedestal 22 nearest each other as shown in FIG. 3. Here again, pins 24, 30 and 36 define points of a structural triangle whereby the seat and back-knee rest combination are made into a rigid structure.

The user of the chair in FIGS. 3 and 4 can now use seat 12 as a support for the buttocks and thighs will using back-knee rest 14 as a support for the knees.

The distance between seat 12 pivot pin 24 and back-knee rest bracket arm 26 pivot pin 30 is determined by the amount of tilt or angle that seat 12 makes with the horizontal and the distance back-knee rest 14 is located away from seat 12 when back-knee rest 14 is positioned below the level of seat 12 and the distance it is located away from seat 12 when positioned above the level of seat 12.

Figure 5:
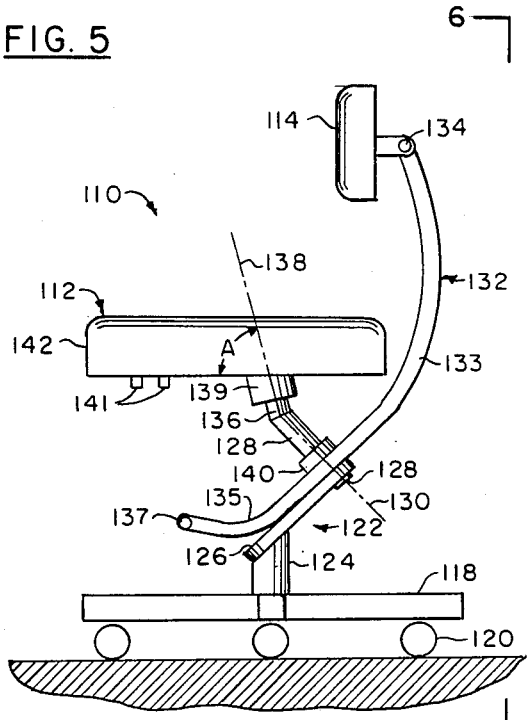
FIG. 5 is a side elevational view of a second embodiment of the convertible chair of the present invention showing the chair with the seat and back-knee rest in their conventional relationship.
Figure 6:
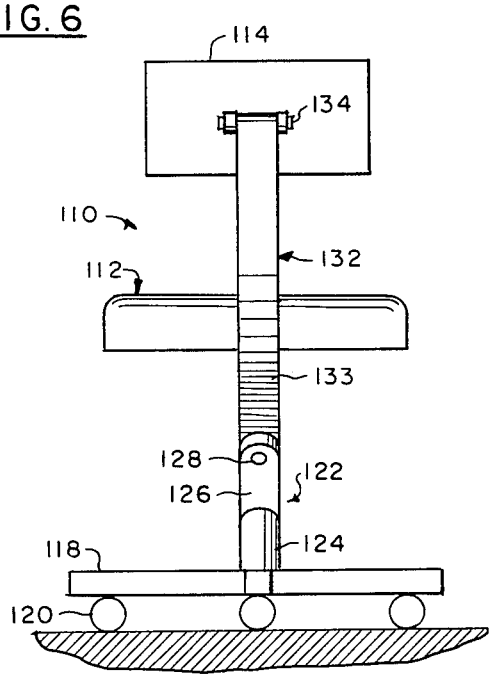
FIG. 6 is a back elevational view of the chair of FIG. 1 taken at line 6—6.
Figure 7:
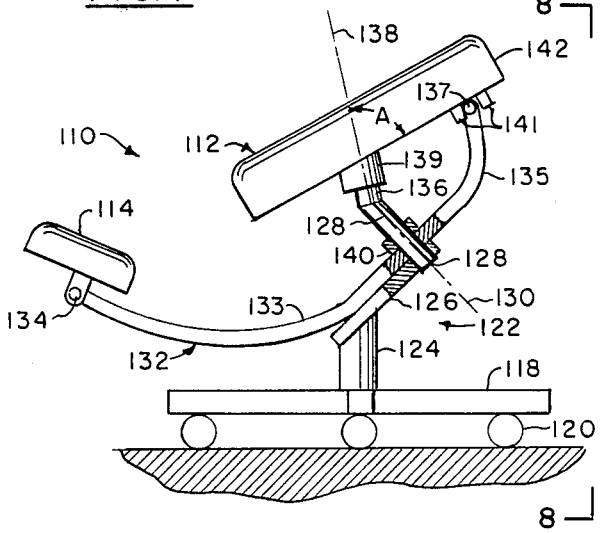
FIG. 7 is a side elevational view of the chair of FIG. 5 in its converted configuration with the seat tilted at an angle and the back-knee rest disposed below the level of the seat at a predetermined angle to the horizontal.
Figure 8:
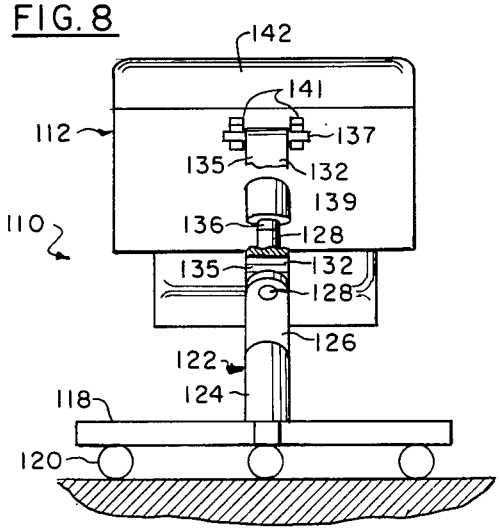
FIG. 8 is a back elevational view of the converted chair of FIG. 7 taken at line 8—8.

With reference to FIGS. 5 through 8, there is illustrated a second embodiment of the convertible chair 110 of the present invention showing it configured as a conventional chair (FIGS. 5 and 6) and as a knee rest chair (FIGS. 7 and 8).

FIG. 5 is a side elevational view of the convertible chair 110 of the present invention in which seat 112 is disposed in a generally horizontal position with back-knee rest 114 disposed in a generally vertical position and located above the level of seat 112. In this position seat 112 is adapted to support the buttocks and thighs of the user while back-knee rest 114 is adapted to support the back of the user.

FIG. 6 is a back elevational view of convertible chair 110 illustrated in FIG. 5 taken at line 6—6.

FIG. 7 is a side elevational view of convertible chair 110 in its converted position in which, what was the front of horizontally disposed seat 112, is now rotated upwardly from the horizontal while back-knee rest 114 is rotated downwardly such that vertically disposed back-knee rest 114, in FIG. 5, is now tilted from the vertical and back-knee rest 114 is located below the level of seat 112. In this position seat 112 is adapted to support the buttocks and thighs of the user while back-knee rest 114 is adapted to support the knees of the user of the chair.

FIG. 8 is a back elevational view of convertible chair 110 shown in FIG. 7 taken at line 8—8.

Convertible chair 110 comprises, basically, a base support 118, mounted on casters or wheel members 120. Attached to base support 120 and projecting upwardly therefrom is support pedestal 122.

Support pedestal 122 comprises a base pedestal 124 attached to base support 118. Proximate the top of support pedestal 124 is back-knee rest bracket arm support plate 126 tilted upwardly at an angle. Attached to back-knee rest bracket arm support plate 126, as by welding or the like, is back-knee rest bracket arm shaft 128 having a longitudinal axis of rotation 130 disposed at right angles to the plane of back-knee rest bracket arm support plate 126.

Back-knee rest bracket arm 132 is journaled to shaft 128 and allowed to rotate about shaft 128 while the other end of back-knee rest bracket arm 132 is pivotally connected to back-knee rest 114 using pivot pin 134. Back-knee rest bracket arm 132 comprises a back-knee rest support end 133 extending from shaft 128 to back-knee rest pivot pin 134, and a seat support end 135 extending from shaft 128 to seat support pin 137.

Bearing block 140 attached to shaft 128, as by set screws or the like, on the side of back-knee rest bracket arm 132 distal back-knee rest bracket arm support plate 126 is used to cause back-knee rest bracket arm 132 to bear against support plate 126 and reduce any bending moment on shaft 128.

Back-knee rest shaft 128 is attached at its top end, as by welding or the like, to the bottom end of seat pivot pin or shaft 136 to become a rigid unit.

The longitudinal axis of rotation 138 of pivot pin or shaft 136 also projects upwardly at an angle which is not necessarily the same angle as the longitudinal axis of rotation 130 of back-knee rest shaft 128.

Hub 139 attached to the underside of seat 112 is journaled to pivot pin or shaft 136 whereby axis of rotation 138 makes and angle "A" with the horizontal plane of seat 112 or the plane of the bottom or top surface of seat 112.

To convert chair 110 from a conventional chair in FIGS. 5 and 6 to a knee rest chair in FIGS. 7 and 8, seat 112 is rotated 180 degrees about shaft 136 so that seat front 142 (in FIG. 5) is positioned to the back (in FIG. 7) and, by virtue of the angle of shaft 136 to the plane of seat 112, seat 112 is tilted upwardly as shown in FIG. 7.

Back-knee rest bracket arm 132 is also rotated 180 degrees from its position in FIG. 5, where back-knee rest is disposed in a vertical plane above the level of seat 112, to the position shown in FIG. 7, where back-knee rest 14 is tilted at an angle to the vertical and is located below the level of seat 112.

Seat support pin 137 is now in a position to engage seat support bracket member 141 attached to the underside of seat 112 in order to provide a rigid position for seat 112.

It can be seen that the angle of tilt of seat 112 is determined by the angle of tilt of longitudinal axis of rotation 138 of shaft 136.

The angle of tilt that seat 112 makes with the horizontal will be double the angle of tilt that longitudinal axis of rotation 138 makes with the vertical.

In a like manner, the angle that back-knee rest 114 makes with the horizontal and its position relative to seat 112 will be determined by the angle that longitudinal axis of rotation 130 makes with the vertical and the position where back-knee rest bracket arm 232 is journaled to shaft 128 relative to seat 112.

By pivoting back-knee rest 114 about pivot pin 134, the tilt of back-knee rest 114 for maximum knee comfort can be adjusted as desired.

With reference to FIGS. 9 through 13, there is illustrated a third embodiment of the convertible chair 210 of the present invention showing it configured as a conventional chair and as a knee rest chair.

FIG. 9 is a side elevational view of the convertible chair 210 of the present invention in which seat 212 is disposed in a generally horizontal position with back-knee rest 214 disposed in a generally vertical position and located above the level of seat 212. In this position seat 212 is adapted to support the buttocks and thighs of the user while back-knee rest 214 is adapted to support the back of the user.

FIG. 10 is a back elevational view of convertible chair 210 illustrated in FIG. 9.

FIG. 11 is a side elevational view of convertible chair 210 in its converted position in which, what was the front of horizontally disposed seat 212, is now rotated upwardly from the horizontal while back-knee rest 214 is rotated downwardly such that vertically disposed back-knee rest 214, in FIG. 9, is now tilted at an angle to the vertical and back-knee rest 214 is located below the level of seat 212. In this position seat 212 is adapted to support the buttocks and thighs of the user while back-knee rest 214 is adapted to support the knees of the user of the chair.

FIG. 12 is a back elevational view of convertible chair 10 shown in FIG. 11 taken at line 12—12.

FIG. 13 is a plan view of the underside of seat 212 showing the structure of the apparatus for maintaining seat 212 in a horizontal or tilted position.

Convertible chair 210 comprises, basically, a base support 218, mounted on casters or wheel members 220. Attached to base support 218 and projecting upwardly therefrom is support pedestal 222.

Pivotally connected proximate the top of pedestal 222 is pivot joint 224 to which seat 212 and seat support 228 are pivotally connected using pivot pin 226.

Also attached proximate the top of pedestal 222 is back-knee rest bracket arm support 230.

A back-knee rest bracket arm 132 is pivotally connected to bracket arm support 230 using pivot pin 234.

Back-knee rest bracket arm 232 comprises a pair of parallel disposed bracket arm legs 236 and 238 as shown in FIGS. 10, 12 and 13. Bracket arm legs 236 and 238 are adapted to straddle pedestal 222 which acts as a guide and support to prevent lateral or sideways movement of back-knee rest bracket arm 232 as it rotates about pivot pin 234.

One end of back-knee rest bracket arm 232 is pivotally connected to back-knee rest 214 using pivot pin 242.

The other end of back-knee rest bracket arm 232 is provided with a bar or rod 244 attached perpendicular to back-knee rest bracket arm 232 and bracket arm legs 236 and 238 (FIG. 13) and cantilevering outwardly therefrom.

Bar or rod 244 is adapted to engage grooves 246 in grooved support blocks 248 and 250 attached to the underside of seat 212 on each side of back-knee rest bracket arm 232.

To convert chair 210 from a conventional chair in FIGS. 9 and 10 to a knee rest chair in FIGS. 11 and 12, seat 212 is rotated about pivot pin 226 to disengage bar or rod 244 from a groove 246 in grooved support blocks 248 and 250.

Back-knee rest bracket arm 232 is then rotated about pivot pin 234 from its position in FIG. 9 where back-knee rest 214 is disposed in a vertical plane above the level of seat 212 to the position shown in FIG. 12 in which back-knee rest 214 is position below the level of seat 212 and tilted at an angle to the vertical.

Seat 212 is then allowed to rotate back so that bar or rod 244 engages another groove 246 in grooved support blocks 248 and 250.

It can be seen that the rigidity of the chair structure is maintained by the fixed positions of pivot pins 234 and 226 and the point of engagement of bar or rod 244 with any one of grooves 246.

The rigidity is further insured by the pressure applied to the seat by the buttocks and thighs of a user of chair 212 as well as the upward pressure of bar of rod 244 against groove 246 resulting from the downward pressure of the knees of the user on back-knee rest 214 acting through pivot pin 234.

With reference to FIGS. 14 through 18, there is illustrated a fourth embodiment of the convertible chair 310 of the present invention showing it configured as a conventional chair and as a knee rest chair.

Figure 14:
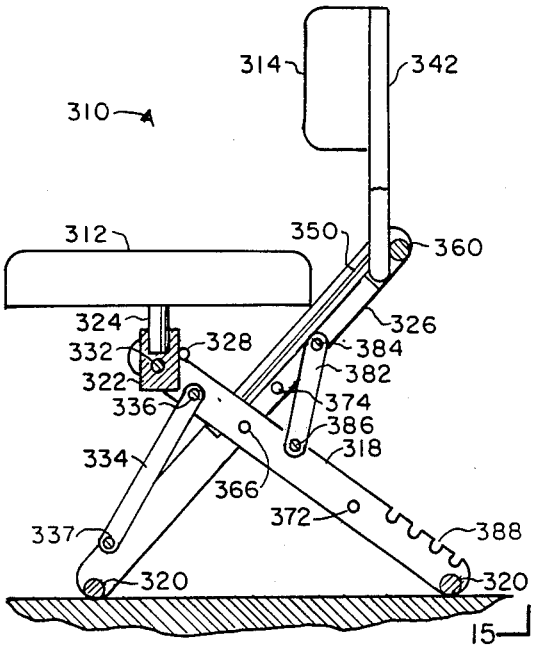
FIG. 14 is a side elevational view of a fourth embodiment of the convertible chair of the present invention showing the chair with the seat and back-knee rest in their conventional relationship.

FIG. 14 is a side elevational view of the convertible chair 310 of the present invention in which seat 312 is disposed in a generally horizontal position with back-knee rest 314 disposed in a generally vertical position and located above the level of seat 312. In this position seat 312 is adapted to support the buttocks and thighs of the user while back-knee rest 314 is adapted to support the back of the user.

Figure 15:
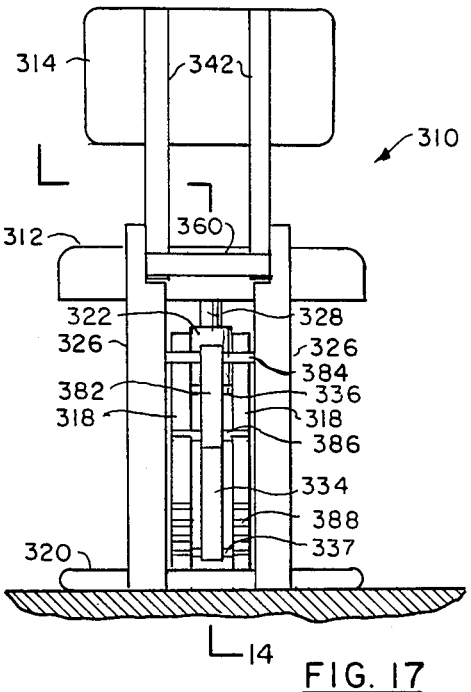
FIG. 15 is a back elevational view of the chair of FIG. 14 taken at line 15—15.

FIG. 15 is a back elevational view of convertible chair 310 illustrated in FIG. 14 taken at line 15—15.

Figure 16:
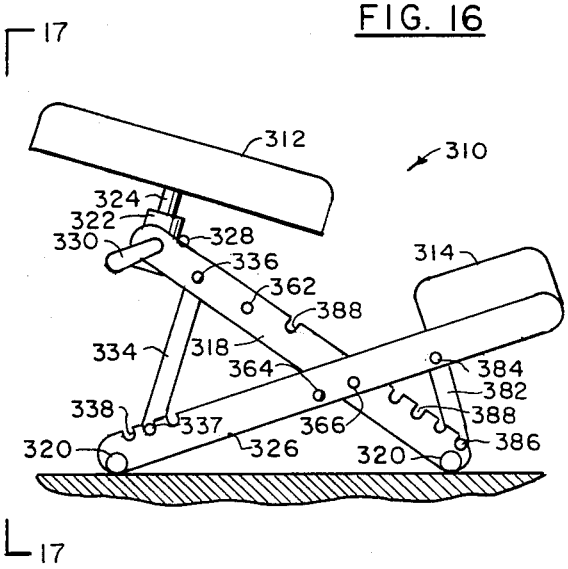
FIG. 16 is a side elevational view of the chair of FIG. 14 in its converted configuration with the seat tilted at an angle and the back-knee rest disposed below the level of the seat at a predetermined angle to the horizontal.

FIG. 16 is a side elevational view of convertible chair 310 in its converted position in which, what was the front of horizontally disposed seat 312, is now rotated upwardly from the horizontal while back-knee rest 314 is rotated downwardly such that vertically disposed back-knee rest 314 (in FIG. 14), is now tilted at an angle to the vertical and back-knee rest 314 is located below the level of seat 312. In this position seat 312 is adapted to support the buttocks and thighs of the user while back-knee rest 314 is adapted to support the knees of the user of the chair.

Figure 17:
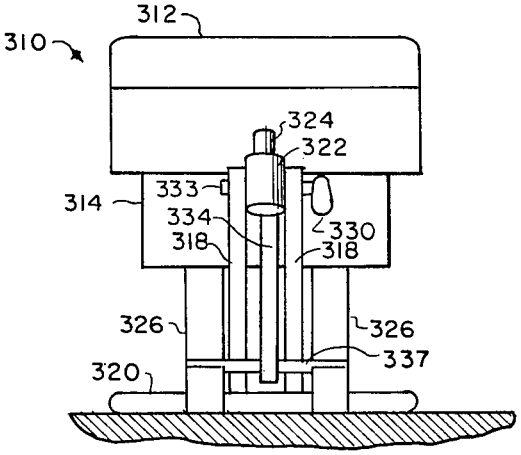
FIG. 17 is a back elevational view of the converted chair of FIG. 11 taken at line 17—17.

FIG. 17 is a back elevational view of convertible chair 310 shown in FIG. 16 taken at line 17—17.

Figure 18:
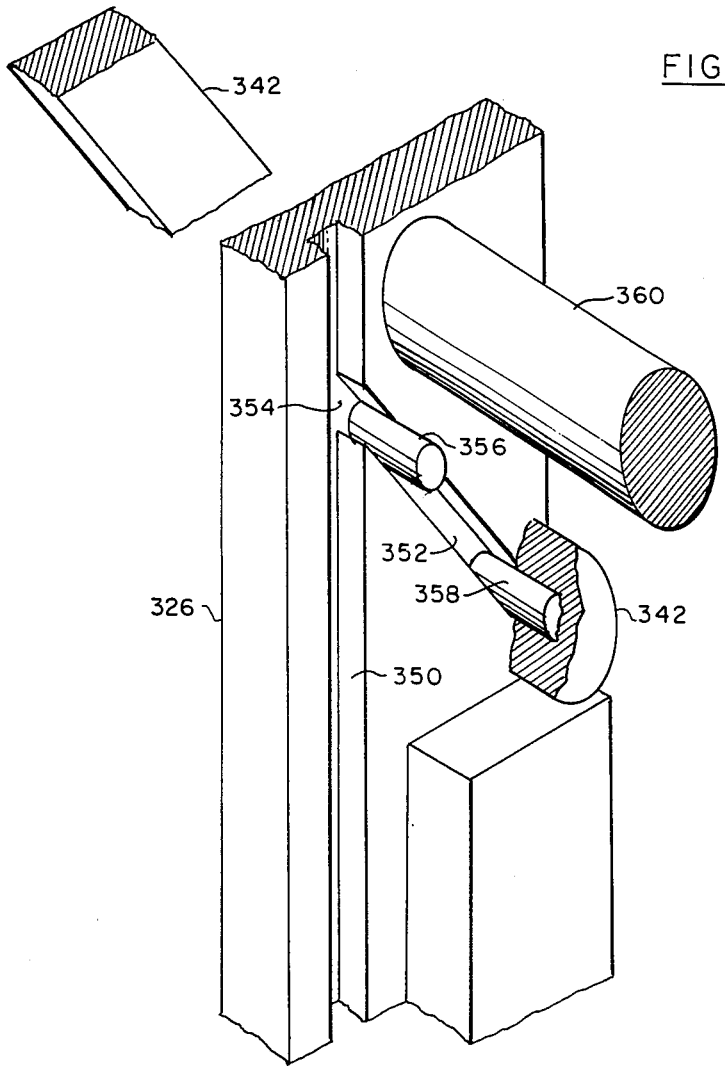
FIG. 18 is an isometric view of the method of connecting the back-knee rest to its support leg.

FIG. 18 is an isometric view of the method of connecting back-knee rest 314 to back-knee rest bracket arm 326 and adjusting it as a backrest and as a knee rest.

Convertible chair 310 comprises, basically, a base support leg 318, mounted on lateral support members 320. Pivotally connected to base support leg 318 by hinge or pivot pin 328 and projecting upwardly therefrom is support pedestal 322.

Journalled to support pedestal 322 is pivot shaft 324 attached to the underside of seat 312 and pivotally connecting seat 312 to base support leg 318. An adjustment handle 330 (FIGS. 16 and 17) in cooperation with a threaded section 332 (FIG. 14) and nut member 333 (FIG. 17), is adapted to frictionally engage base support leg member 318 so that the tilt of seat 312 can be adjusted relative to base support member 318.

A spreader support member 334 is pivotally connected, at one end, using pivot pin 336, to base support leg 318 and at it other end is adapted to engage one of several grooves 338.

Attached to back-knee rest 314 is back-knee rest support bracket 342.

With reference to FIG. 18, the inside portion of back-knee rest bracket arm 326 proximate back-knee rest 314 is provided with a first groove 350 running parallel to the longitudinal axis of back-knee rest bracket arm 326.

A second groove 352 intersecting first groove 350 at junction 354 is provided proximate the upper or top end of back-knee rest bracket arm 326 and with the longitudinal axis of groove 352 running at an angle to the longitudinal axis of back-knee rest bracket arm 326 such that the longitudinal axis of groove 352 will be disposed vertically when chair 310 is in its conventional configuration shown in FIGS. 14 and 15.

Grooves 350 and 352 are adapted to receive pin or guide members 356 and 358 attached to back-knee rest suppport bracket 342.

A back-knee rest bracket arm support bar connector member 360 connects the two back-knee rest support legs 326 together. Back-knee rest bracket arm support bar connector member 360 also acts as a further support for back-knee rest support bracket 342 proximate its lower end when chair 310 is in the conventional position shown in FIG. 14, and as a support proximate the top end of back-knee rest support bracket 342 when the chair is converted to a knee rest chair as shown in FIG. 16.

As can be seen in FIG. 16, a first hole 362 is provided in base support 318 while a second hole 364 is provided in Back-knee rest bracket arm 326.

When first hole 362 in base support leg 318 is aligned with second hole 364 in back-knee rest bracket arm 326, a pin 366 (as shown in FIG. 14) can be inserted into both holes so that base support 318 is fixedly connected to back-knee rest bracket arm 326 when chair 310 is converted to a conventional chair.

As can be seen in FIG. 14, a third hole 372 is provided in base support leg 318 and a fourth hole 374 is provided in back-knee rest bracket arm 326.

When third hole 372 is aligned with fourth hole 374, pin 366 (as shown in FIG. 16) can be now inserted into both holes so that base support 318 is fixedly connected to back-knee rest bracket arm 326 when chair 310 is converted to a knee rest chair.

A further support arm 382 can be provided to furnish additional rigidity to chair 310.

Support arm 382 is pivotally connected to back-knee rest support arm 326 using pivot pin 384. Support pin 386 is attached the other end of support arm 382 and is adapted to engage one of several grooves 386 (FIG. 16) when chair 310 is in the conventional position (FIG. 14).

When converted to a knee rest chair, support pin 386 attached to support arm 382 is adapted to engage one of several grooves 388 in base support leg 318.

To convert chair 310 from a conventional chair, as shown in FIG. 14, to a knee rest chair, as shown in FIG. 16, back-knee rest 314 is moved vertically upward allowing pins or guides 354 and 356 (FIG. 18) to slide upwardly guided by second groove 352 until pins 354 and 356 reach the intersection 354 of first groove 350 with second groove 352.

When pin or guide 356 is in a position to engage first groove 350, back-knee rest 314 is rotated to align pins or guides 354 and 356 with first groove 350 to allow back-knee rest 314 to now assume a position parallel to back-knee rest bracket arm 326 and slide down into the knee rest position shown in FIG. 16.

Pin 366 is removed from first and second holes 362 and 364, respectively, and back-knee rest bracket arm 326 is rotated downwardly until third and fourth holes 374 and 376 are aligned. In this position, pin 366 is inserted to engage both third and fourth holes 374 and 376, respectively.

When an appropriate height of seat 312 is established, pin 337 of spreader support member 334 is then placed in the nearest groove 338 so that a three point support is provided defined by pivot pin 336, pin 366 and a groove 338.

When the appropriate height of back-knee rest 314 is established, pin 386 of support arm 382 placed in one or several grooves 388.

Adjustment handle 330 is then operated to adjust the angle of seat 312 for maximum comfort.

To convert chair 310 back into the conventional chair of FIG. 14, the process is reversed whereby back-knee rest bracket arm 326 is rotated upwardly raising back-knee rest 314 from a position below the level of seat 312 to a position above the level of seat 312.

Back-knee rest 14 is also rotated from a position parallel to back-knee rest bracket arm 326 to a vertical position at an angle to back-knee rest bracket arm 326.

Thus is disclosed a chair that will convert from a conventional chair to a knee rest chair.

I claim:

1. A convertible chair comprising a base support, a seat pivotally connected to said base support, a back-knee rest connected to said base support, means located between said seat and said back-knee rest for tilting said seat from a first predetermined angle of tilt relative to a horizontal plane to a second predetermined angle of tilt relative to said horizontal plane and moving said back-knee rest from a position above the level of said seat to a position below the level of said seat comprising a generally arcuate back-knee rest bracket arm having a first end and a second end, said first end pivotally connected to the underside of said seat proximate the side of said pivotal connection of said seat to said base support distal said back-knee rest, the distance between said point of pivotal connection of said first end of said arcuate bracket arm and said point of pivotal connection of said seat to said base support being determined by the angle of tilt of said seat to the horizontal and the distance said back-knee rest is located from said seat when used as a back rest and when used as a knee rest, means for connecting said second end of said generally arcuate bracket arm to said back-knee rest, and means for connecting said generally arcuate bracket arm to said base support at various points between the two ends of said arcuate bracket arm and at various elevations on said base support below the level of said seat.

2. A convertible chair comprising a base support comprising a base support arm projecting upwardly from said base support, a shaft connected proximate the top of said base support arm, the longitudinal axis of said shaft tilting at a predetermined angle to the vertical, a seat, a back-knee rest, means for tilting said seat comprising said seat journalled to said shaft, said seat disposed at a first predetermined angle of tilt relative to a vertical plane when placed in a first position and said seat disposed at a second predetermined angle of tilt relative to said vertical plane when said seat is rotated 180 degrees on said shaft to a second position, means for tilting said back-knee rest comprising a back-knee rest bracket arm having one end connected to said back-knee rest and with the other end of said back-knee rest journalled to said shaft at an angle whereby 180 degree rotation of said back-knee rest bracket arm rotates said back-knee rest from a first position above said seat, where said back-knee rest is adapted to support the back of a user, to a second position below said seat with said back-knee rest disposed at a predetermined angle of tilt relative to said vertical plane and adapted to support the knees of a user of said chair.

3. A convertible chair comprising a base support comprising a base support arm projecting upwardly from said base support, a shaft connected proximate the top of said base support arm, the longitudinal axis of said shaft tilting at a predetermined angle to the vertical, a seat, a back-knee rest, means for tilting said seat comprising said seat journalled to said shaft, said seat disposed at a first predetermined angle of tilt relative to a vertical plane when placed in a first position and said seat disposed at a second predetermined angle of tilt relative to said vertical plane when said seat is rotated 180 degrees on said shaft to a second position, means for tilting said back-knee rest comprising a back-knee rest bracket arm having first and second ends, said first end connected to said back-knee rest and said second end journaled at an angle to said shaft, said back-knee rest bracket arm and said back-knee rest disposed at a first predetermined angle of tilt relative to said vertical plane with said back-knee rest disposed above said seat at a first position, said back-knee rest bracket arm and said back-knee rest disposed at a second predetermined angle of tilt with respect to said vertical plane when said back-knee rest bracket arm is rotated 180 degrees on said shaft to a second position in which said back-knee rest is disposed below said seat.

4. A convertible chair comprising a base support, a seat pivotally connected to said base support, a back-knee rest connected to said base support, means located between said back-knee rest and said base support for moving said back-knee rest from a first position above level of said seat, at which position said back-knee rest is adapted to support the back of a user, to a second position below the level of said seat and at a predetermined angle of tilt relative to a horizontal plane, at which position said back-knee rest is adapted to support the knees of a user of said chair, said means comprising a first bracket arm connected proximate one end of said back-knee rest and pivotally connected proximate its other end to said base support, and means located between said seat and said base support for tilting said seat from a first predetermined angle of tilt relative to a horizontal plane when said back-knee rest is positioned above said seat, at which position said seat is adapted to support the thighs and buttocks of a user of said chair and said back-knee rest is adapted to support the back of a user of said chair, to a second predetermined angle of tilt relative to said horizontal plane when said back-knee rest is positioned below said seat, at which position said seat is adapted to support the thighs and buttocks of said user of said chair and back-knee rest is adapted to support the knees of said user of said chair, said means comprising a grooved support block attached to said seat, a second bracket arm attached proximate one end to the end of said first bracket arm proximate its point of pivotal connection to said base support, and a support bar attached proximate the other end of said second bracket arm and adapted to engage said grooved support block.

* * * * *